United States Patent [19]

Dhyanchand et al.

[11] Patent Number: 4,947,100

[45] Date of Patent: Aug. 7, 1990

[54] POWER CONVERSION SYSTEM WITH STEPPED WAVEFORM INVERTER HAVING PRIME MOVER START CAPABILITY

[75] Inventors: P. John Dhyanchand; Vietson Nguyen, both of Rockford, Ill.

[73] Assignee: Sundstrand Corporation, Rockford, Ill.

[21] Appl. No.: 421,830

[22] Filed: Oct. 16, 1989

[51] Int. Cl.[5] ..... F02N 11/04

[52] U.S. Cl. ..... 322/10; 290/38 R; 290/46; 363/37; 363/71

[58] Field of Search ..... 363/37, 71, 72; 322/10, 322/11, 13, 32, 61; 290/31, 38 R, 46

[56] References Cited

U.S. PATENT DOCUMENTS

| | | | |
|---|---|---|---|
| 3,775,662 | 11/1973 | Compoly et al. . | |
| 4,743,777 | 5/1988 | Shilling et al. | 290/46 |
| 4,786,582 | 11/1988 | Cook | 322/10 |
| 4,841,216 | 6/1989 | Okada et al. | 290/46 |
| 4,862,341 | 8/1989 | Cook | 322/12 |

*Primary Examiner*—William H. Beha, Jr.
*Attorney, Agent, or Firm*—Marshall, O'Toole, Gerstein, Murray & Bicknell

[57] ABSTRACT

A power conversion system is operable in a generating mode to convert motive power developed by a prime mover into electrical power and in a starting mode to convert electrical power developed by a source of AC power into motive power for starting the prime mover. The system includes a rectifier having an output coupled to a DC link, first and second inverters, each coupled to the DC link and transformer including first and second sets of primary windings and a set of secondary windings wherein the second set of primary winding is coupled to an output of the second inverter. Contactors are provided for coupling the rectifier to the generator armature windings and the first set of primary windings to an output of the first inverter so that AC power produced by the generator is converted into DC power on the DC link and the DC power is converted into fixed frequency AC power which is developed in the set of secondary windings. The contactors are operable in the starting mode to couple the source of AC power to the set of secondary windings, the first set of primary windings to the rectifier and the output of the first inverter to the generator armature windings so that the AC power induced in the first set of primary windings due to application of AC power to the set of secondary windings is converted into DC power on the DC link and the DC power is converted into AC power at a controlled voltage and frequency which is applied to the generator armature windings.

8 Claims, 5 Drawing Sheets

POWER CONVERSION SYSTEM WITH STEPPED WAVEFORM INVERTER HAVING PRIME MOVER START CAPABILITY

TECHNICAL FIELD

The present invention relates generally to power conversion systems, and more particularly to such a system which may be used either in a generating mode to convert mechanical power developed by a prime mover into electrical power or in a starting mode to convert electrical power into motive power for starting the prime mover.

BACKGROUND ART

In a power conversion system such as a variable speed, constant frequency (VSCF) power generating system, a brushless, three-phase synchronous generator operates in a generating mode to convert variable speed motive power supplied by a prime mover into variable frequency AC power. The variable frequency power is rectified and provided over a DC link to a controllable static inverter. The inverter is operated to produce constant frequency AC power, which is then supplied over a load bus to one or more loads.

As is known, a generator can also be operated as a motor in a starting mode to convert electrical power supplied by an external AC power source into motive power which may in turn be provided to the prime mover to bring it up to self-sustaining speed. In the case of a brushless, synchronous generator including a permanent magnet generator (PMG), an exciter portion and a main generator portion mounted on a common shaft, it has been known to provide power at a controlled voltage and frequency to the armature windings of the main generator portion and to provide field current to the main generator portion via the exciter portion so that the motive power may be developed. This has been accomplished in the past, for example, using two separate inverters, one to provide power to the main generator portion armature windings and the other to provide power to the exciter portion. Thereafter, operation in the generating mode may commence whereupon DC power is provided to the exciter field winding.

Cook, U.S. Pat. No. 4,786,852, assigned to the assignee of the instant invention, discloses a power conversion system including a starting arrangement in which a brushless generator is operated as a motor to bring an engine up to self-sustaining speed. A rectifier bridge of a VSCF system is modified by adding transistors in parallel with the rectifiers of the bridge and the transistors are operated during a starting mode of operation to convert DC power provided on a DC link by a separate VSCF system or auxiliary power unit into AC power. The AC power is applied to armature windings of the brushless generator to cause a rotor of the generator to be accelerated.

Shilling, et al., U.S. Pat. No. 4,743,777 discloses a starter/generator system including a brushless, synchronous generator. The system is operable in a starting mode to produce motive power from electrical power provided by an external AC power source. An exciter of the generator includes separate DC and three-phase AC field windings disposed in a stator. When operating in a starting mode at the beginning of a starting sequence, the AC power developed by the external AC power source is directly applied to the three-phase AC exciter field windings. The AC power developed by the external AC source is further provided to a variable voltage, variable frequency power converter which in turn provides a controlled voltage and frequency to the armature windings of a main generator. The AC power provided to the AC exciter field windings is transferred by transformer action to exciter armature windings disposed on a rotor of the generator. This AC power is rectified by a rotating rectifier and provided to a main field winding of the generator. The interaction of the magnetic fields developed by the main generator field winding and armature windings in turn causes the rotor of the generator to rotate and thereby develop the desired motive power. When the generator is operated in a generating mode, switches are operated to disconnect the AC exciter field windings from the external AC source and to provide DC power to the DC exciter field winding. The power converter is thereafter operated to produce AC output power at a fixed frequency.

Compoly, et al., U.S. Pat. No. 3,775,662, discloses a power converter which includes four inverter bridges that are in turn coupled to wye-and delta-connected primary windings of a transformer. Secondary windings of the transformers are connected in series to sum three-phase outputs developed in the windings. The bridges are controlled such that 24-four step output phase voltages are produced.

SUMMARY OF THE INVENTION

In accordance with the present invention, an improved system is provided for the generation of AC power and for starting of a prime mover.

More particularly, a power conversion system utilizing a brushless generator coupled to a prime mover and operable in generating and starting modes includes a rectifier having an output coupled to a DC link, first and second inverters each coupled to the DC link and a transformer including first and second sets of primary windings and a set of secondary windings wherein the second set of primary windings is coupled to an output of the second inverter. Means are operable in the generating mode for coupling the rectifier to a set of generator armature windings and the first set of primary windings to an output of the first inverter. Such means are operable in the starting mode for coupling the source of AC power to the set of secondary windings, the first set of primary windings to the rectifier and the output of the first inverter to the generator armature windings. The inverters are controlled in the generating mode by a control unit to convert DC power on the DC link into fixed frequency power which is developed in the set of secondary windings during operation in the starting mode, AC power induced in the first set of primary windings due to the application of AC power to the set of secondary windings is converted into DC power on the DC link and the DC power is converted by the first inverter into AC power at a controlled frequency and is applied to the generator armature windings.

In the preferred embodiment, the power conversion system further includes third and fourth inverters coupled to the DC link and third and fourth sets of primary windings associated with the transformer. The inverters are controlled to produce a stepped AC waveform in the set of secondary windings while operating in the generating mode. During operation in the starting mode, the output of the third inverter is coupled in parallel with the output of the first inverter and both inverters are operated to provide electrical power to the generator armature windings.

The present invention produces fewer harmonics when operating in the generating mode and, in addition, has the capability of starting a prime mover without the need for a dedicated starter motor.

DESCRIPTION OF THE PREFERRED EMBODIMENT

Figure 1:
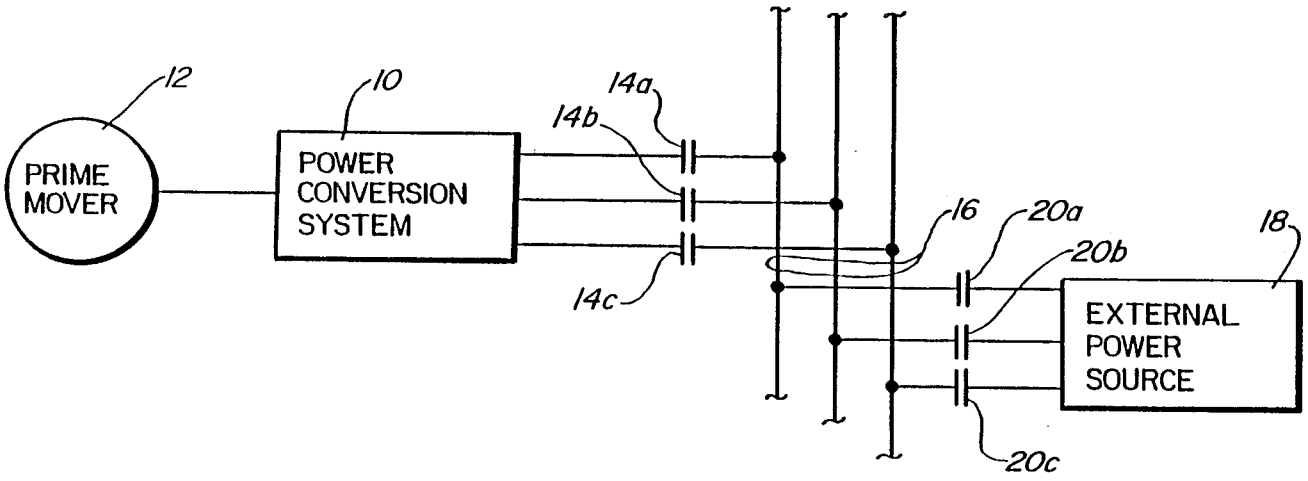
FIG. 1 is a block diagram of a power generating system incorporating the present invention.

Referring now to FIG. 1, a power conversion system 10 in the form of a variable speed, constant frequency (VSCF) system operates in a generating mode to convert variable speed motive power produced by a prime mover 12, such as an aircraft jet engine, into constant frequency three-phase AC electrical power which is delivered through controllable contactors 14*a*, 14*b* and 14*c* to a load bus 16. The VSCF system 10 is also operable in a starting mode using three-phase AC power provided by an external power source 18, such as a ground power cart. During operation in the starting mode, the power source 18 is coupled to the load bus 16 through controllable contactors 20*a*–20*c*. If necessary or desirable, the electrical power for use by the VSCF system 10 in the starting mode may be provided by another source of power, such as another VSCF system which is driven by a different prime mover. In any event, the VSCF system 10 converts electrical power into motive power when operating in the starting mode to bring the prime mover 12 up to self-sustaining speed. Once this self-sustaining speed (also referred to as "light-off") is reached, the prime mover 12 may be accelerated to operating speed, following which operation in the generating mode may commence.

Figure 2:
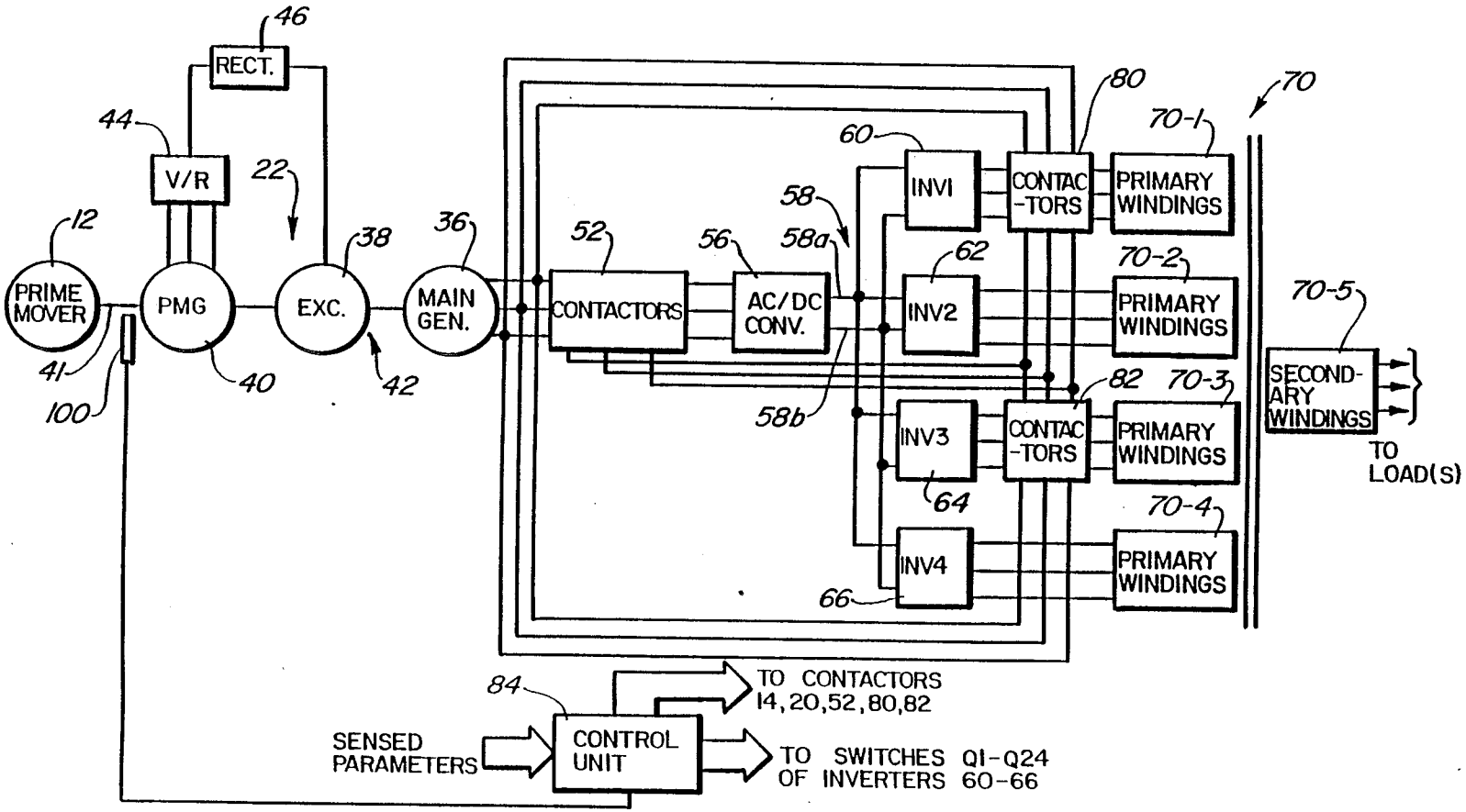
FIG. 2 is a simplified combined mechanical and electrical block diagram of the power generating system shown in FIG. 1.

Referring now to FIG. 2, the VSCF system 10 includes a generator 22 driven by the prime mover 12. Preferably, the generator 22 is of the brushless, synchronous type, although a different generator may be used, such as a permanent magnet generator.

The generator 22 includes a main generator portion 36 including three armature windings 36*a* 36*b*, and 36*c* (shown in FIG. 3), an exciter portion 38 and a permanent magnet generator (PMG) 40, all of which include rotor structures mounted on a common shaft 41 of a rotor 42. In the generating mode of operation, rotation of the common shaft 41 by the prime mover 12 causes polyphase power to be developed in armature windings of the PMG 40 which is in turn delivered to a voltage regulator 44. The voltage regulator 44 and a rectifier 46 deliver a controlled magnitude of DC current to field windings of the exciter 38. This current induces an AC voltage in armature windings of the exciter 38 which is rectified by a rotating rectifier. The resulting DC power is supplied to a field winding (not shown) in the main generator 36. Rotation of the common shaft 41 while the field current is flowing in the field winding of the main generator portion 36 causes polyphase voltages to be developed in armature windings of the main generator portion 36. The frequency of these voltages varies with the speed of the shaft 41.

Figure 3:
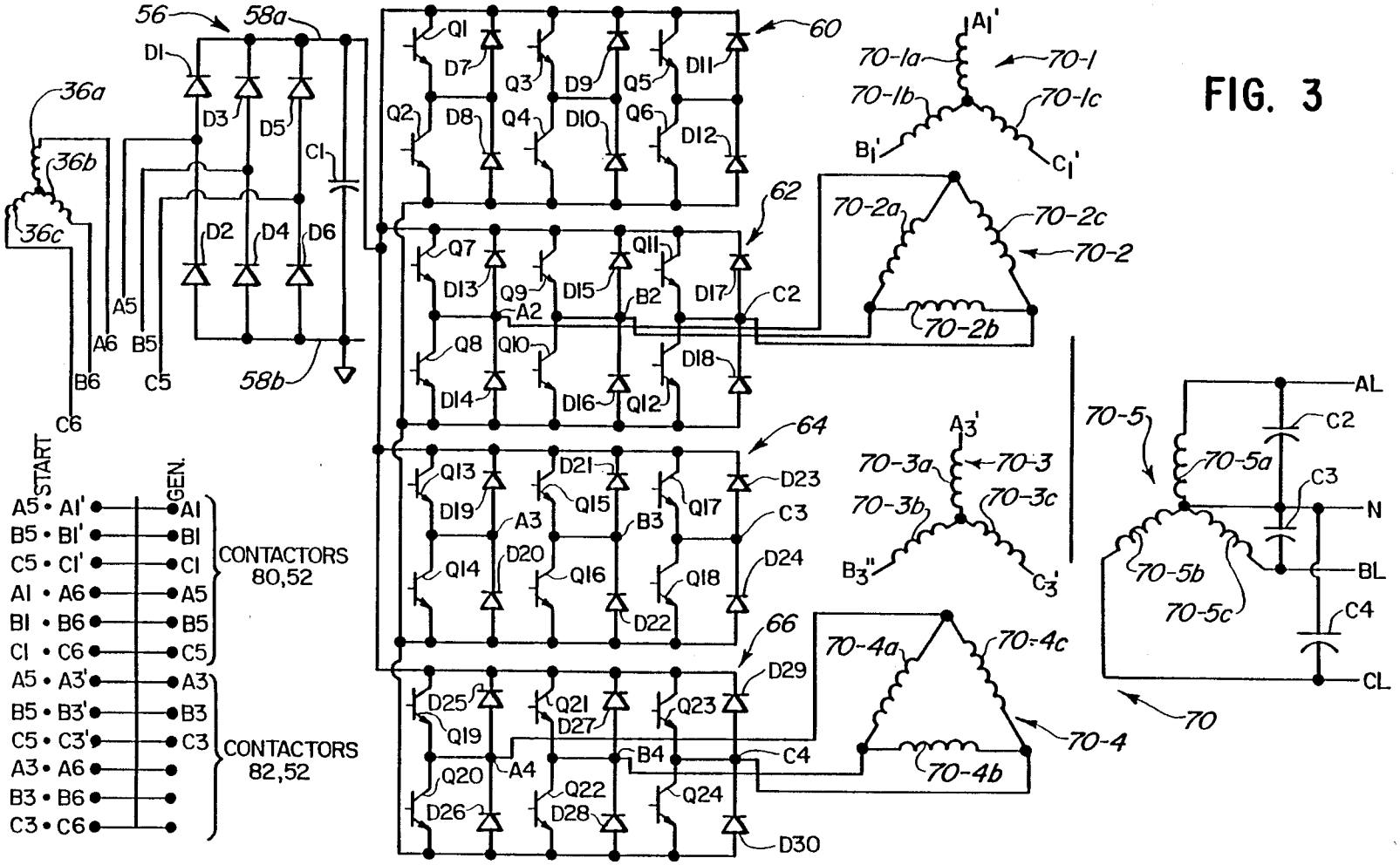
FIG. 3 is a simplified schematic diagram of the electrical power converter components, together with the generator armature windings.

When operating in the generating mode, the polyphase voltages are supplied through a first set of contactors 52 to an AC/DC power converter 56, and the latter converts the AC power into first and second DC potentials on first and second conductors 58*a* and 58*b* (FIG. 3) of a DC link 58. With reference to FIG. 3, the converter 56 is formed by a plurality of power diodes D1–D6 connected in a bridge arrangement. A filter capacitor C1 is connected across the conductors 58*a* and 58*b*.

Referring now to FIG. 2, the DC power on the DC link is provided to first through fourth inverters 60, 62, 64 and 66. As seen in FIG. 3, each inverter 60, 62, 64 and 66 includes six power switches Q1–Q6, Q7–Q12, Q13–Q18 and Q19–Q24, respectively, which are connected together in a bridge configuration. Connected across each switch Q1–Q14 is an anti-parallel diode D7–D30 which provides a path for reactive currents during operation. Each inverter 60–66 develops three phase outputs at junctions A1–C1, A2–C2, A3–C3 and A4–C4 between series connected power switches. The junctions A2–C2 and A4–C4 of the inverters 62 and 66, respectively, are coupled to vertices of sets of primary windings 70-2 and 70-4 of a transformer 70. These sets of windings, as well as additional sets of primary windings 70-1 and 70-3 are magnetically linked to a set of secondary windings 70-5 of the transformer 70. In the preferred embodiment, the sets 70-1, 70-3 and 70-5 include windings 70-1*a* through 70-1*c*, 70-3*c* through 703*c* and 70-5*a* through 70-5*c* which are connected together in a wye configuration while the sets 70-2 and 70-4 include windings 70-2*a* through 70-2*c* and 70-4*a* through 70-4*c* connected in a delta configuration. The windings 70-5*a* through 70-5*c* are coupled to a capacitive filter comprising capacitors C2–C4 which are in turn coupled by the contactors 14*a*–14*c* to the load bus 16 during operation in the generating mode.

Figure 4:
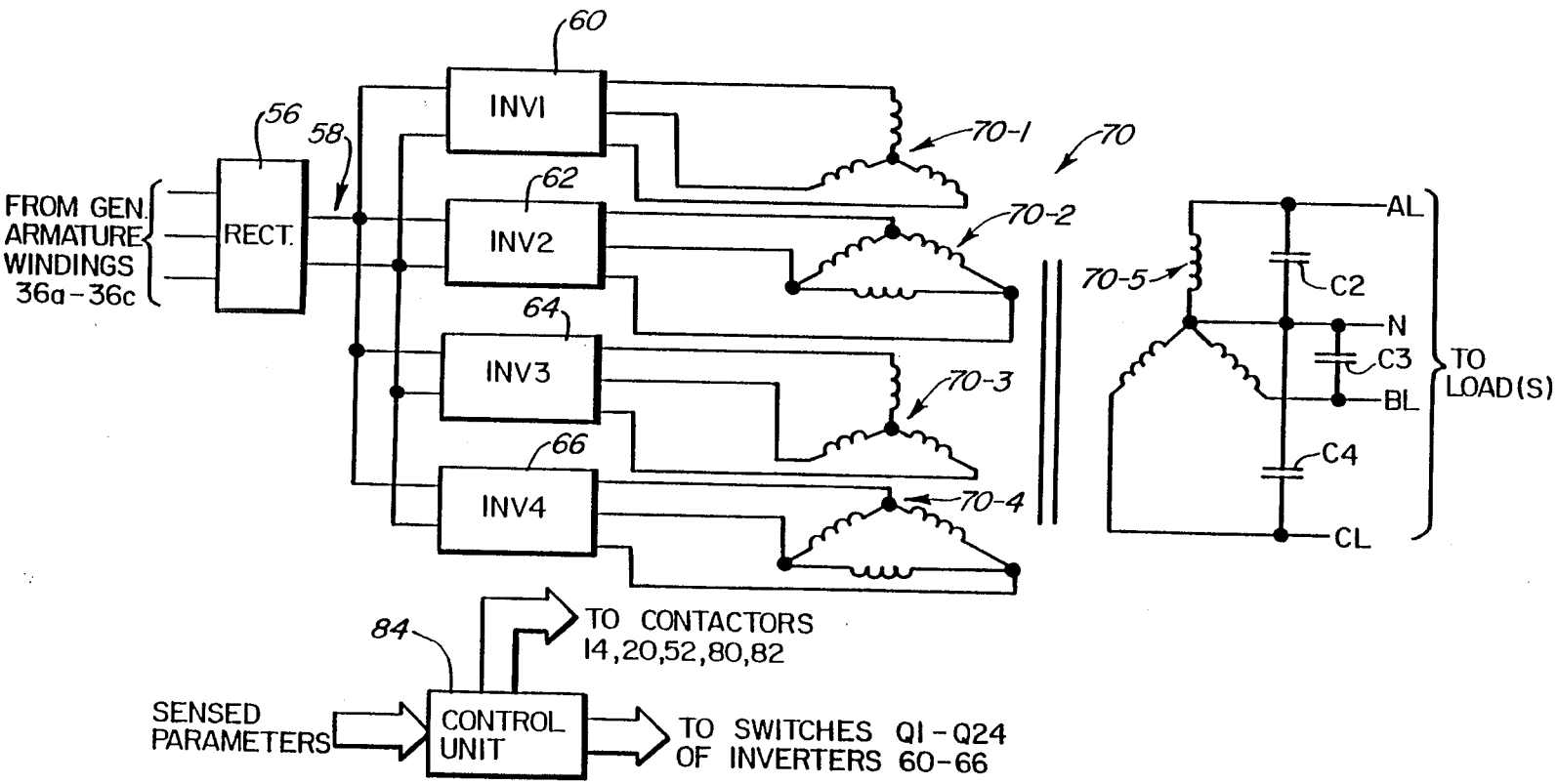
FIGS. 4 and 5 are simplified combined schematic and block diagrams of the system of FIG. 3 showing the interconnection of the various system components during operation in the generating and starting modes, respectively.

Referring again to FIG. 2, during operation in the generating mode, the junctions A1–C1 and A3–C3 of the inverters 60 and 64, respectively, are coupled by contactors 80 and 82 to respective windings 70-1*a* through 70-1*c* and 70-3*a* through 70-3*c* of the secondary windings 70-1 and 70-3. Thus, as illustrated in FIG. 4, the AC power developed in the generator armature windings 36*a*–36*c* is rectified to produce DC power on the DC link 58. The inverters 60–66 are operated by a control unit 84 in response to one or more sensed parameters of the system 10 to cause a stepped waveform to be produced in the set of secondary windings 70-5 of the transformer 70. Specifically, the inverters 60–66 are operated to produce a 24-step, three-phase output waveform which is provided to the load bus 16.

FIG. 3 illustrates the operation of the contactors 52, 80 and 82 in the generating and starting modes. The contactors are represented by a series of double-throw switches which are ganged together. During operation in the generating mode, the switches are in the position shown in FIG. 3 such that the main generator armature windings 36*a*–36*c* are connected to the contactors 52, the first inverter 60 is coupled to the first set of primary windings 70-1 and the third inverter 64 is coupled to the third set of primary windings 70-3. The system configuration in this mode is illustrated in FIG. 4.

Figure 5:
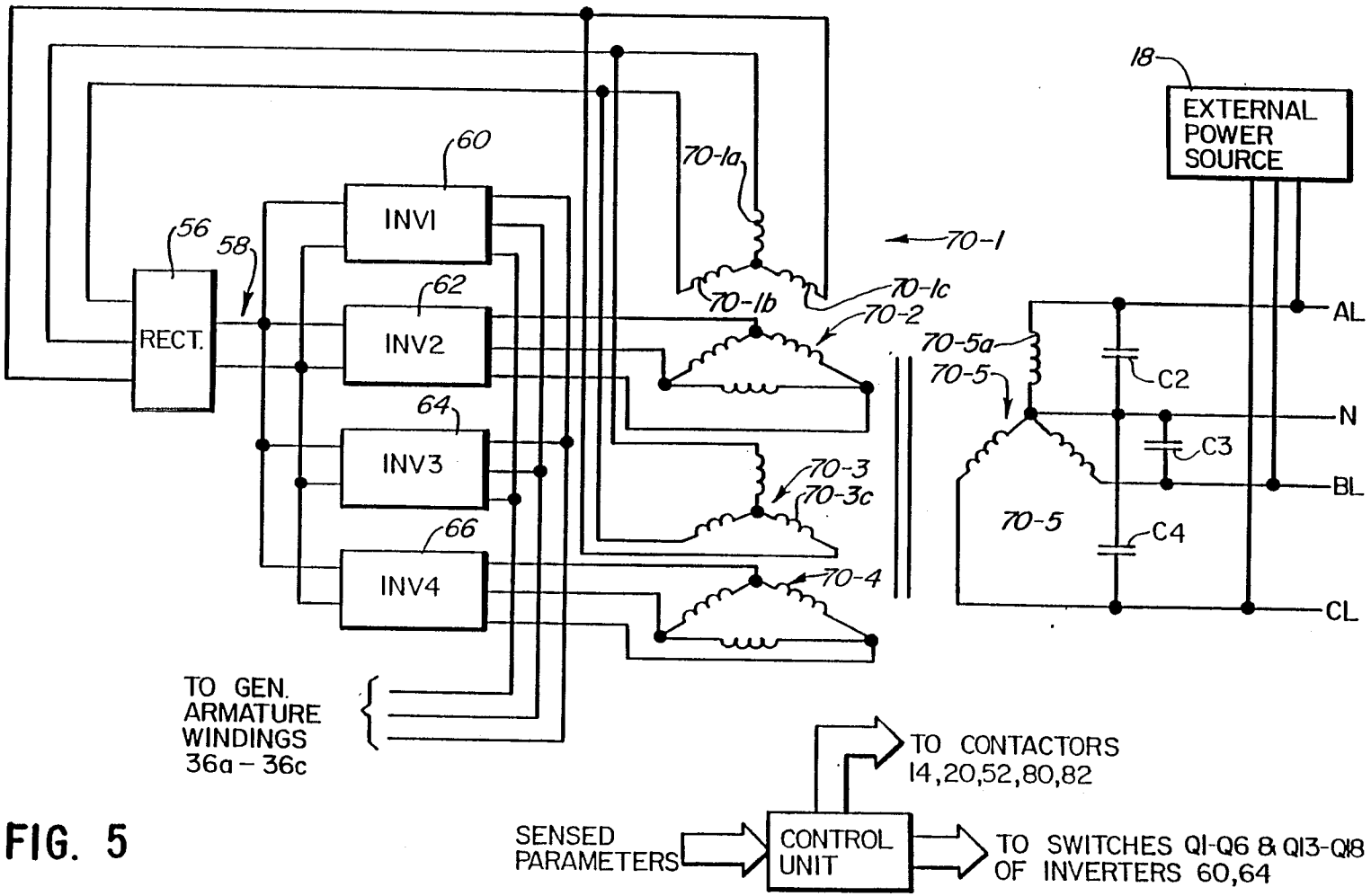

During operation in the starting mode, the contactors 52, 80 and 82 are operated in a fashion represented by movement of the switches of FIG. 3 to the positions opposite those shown. Thus, as seen in FIG. 5, the first and third sets of primary windings 70-1 and 70-3 are coupled in parallel to the input of the rectifier 56 and the outputs of the first and third inverters 60, 64 are coupled in parallel to the main generator armature windings **36*a*–36*c*. More specifically, the inverter junctions A1 and A3 are coupled to the generator armature winding 36*a*, while the junctions Bl and B3 are connected to the generator armature winding 36*b* and the outputs junctions C1 and C3 are connected to the generator armature winding 36*c*. In addition, the contactors 20*a*–20*c* and 14*a*–14*c* are closed so that the external power source 18 is coupled to the set of secondary windings 70-5. The AC power flowing in the set of secondary windings 70-5 causes AC voltages to be developed in the sets of primary windings 70-1 and 70-3. The contactors 52, 80 and 82 connect the sets of primary windings 70-1 and 70-3 in parallel to the rectifier 56**.

The rectifier 56 rectifies the AC power from the sets of primary windings 70-1 and 70-3 and provides DC power to the DC link 58. In addition, the switches Q7–Q12 and Q19–Q24 are not operated at this time (i.e., opened) and hence, further DC power is provided by the rectifiers D13–D18 and D25–D30 of the inverters 62,66 to the DC link 58. The DC link power is in turn provided to the inverters 60 and 64. The control unit 84 operates the switches Q1–Q6 and Q13–Q18 of the inverters 60, 64 to in turn produce AC power at a controlled voltage and frequency. Preferably, the inverters 60,64 produce identical six-step waveforms which are in phase so that the inverters 60,64 are operated in parallel. The inverters 60,64 could produce a different AC waveform, such as a pulse-width modulated waveform, if desired.

The control unit 84 operates the switches Q1–Q6 and Q13–Q18 to provide AC power at a increasing voltage and frequency to the generator armature windings **36*a*–36*c*. Preferably, this power is provided at a constant volts-per-hertz ratio. Also during this time, the main generator portion field winding is provided power via the exciter 38 so that the common shaft 41 of the rotor 42 is accelerated to thereby develop the desired motive starting power for the prime mover 12. The power for the main generator portion field winding may be provided by the external power source 18 using the circuits and structures disclosed in Dhyanchand, copending Application, Serial No. 07/408,928, filed Sept. 18 1989, entitled "Brushless Generator Having a Three-Phase Combined AC/DC Field Winding", assigned to the assignee of the instant application and the disclosure of which is hereby incorporated by reference. As described more fully in such application, at the beginning of operation in the starting mode, the external power source 18 is connected by contactors to a set of three-phase exciter field windings. This AC power induces AC power in the exicter armature windings by transformer action and the induced AC power is rectified by the rotating rectifier and provided to the main generator field winding. Once the common shaft 41** has been accelerated to a particular speed, the exciter field windings are reconnected into a DC configuration wherein two of the exciter field windings are connected in a parallel combination and the third winding is connected in series with the parallel combination. DC power is thereafter applied to the exciter field windings so that operation in the generating mode may commence.

It should be noted that the present system may alternatively use other circuits and structures to provide power to the main generator portion field winding during operation in the starting mode, if desired.

It should also be noted that a different number of the inverters 60–66 could be operated in parallel to produce AC power, in which case a different number of inverters would produce DC power on the DC link 58. For example, three inverters 60, 62 and 64 could be operated in parallel to produce AC starting power, in which case only the diodes D25–D30 of the inverter produce DC power of the DC link 58. Such a system, however, would require a different contactor arrangement to disconnect the windings **70-2*a* through 70-2*c* from the inverter 62 and to connect these windings in parallel with the windings 70-4*a* through 70-4*c*** during operation in the starting mode.

Further, the system could instead include six (or more) inverters which are operated as a 36-step (or greater) inverter system in the generating mode. In this case three (or more) inverters can be operated in parallel to produce AC power in the starting mode and the switches of the remaining inverters turned off or opened so that the diodes of these inverters produce DC power on a DC link.

During operation in the starting mode, the control unit 84 senses the output of a speed sensor 100 to determine when the speed of the shaft 41 has reached a speed indicative of the self sustaining speed of the prime mover 12. Upon reaching this speed, the control 84 operates the contactors 20, 52, 80 and 82 to reconnect the system into the generating mode configuration shown in FIG. 4. Thereafter, once the control unit 84 detects that the prime mover 12 has reached operating speed, the switches Q1–Q24 of the inverter 60–66 are operated to commence operation in the generating mode.

We claim:

1. A power conversion system utilizing a generator having armature windings and coupled to a prime mover wherein the power conversion system is operable in a generating mode to convert motive power developed by the prime mover into electrical power and in a starting mode to convert electrical power developed by a source of AC power into motive power for starting the prime mover, comprising:

a rectifier having an output coupled to a DC link;

first and second inverters each coupled to the DC link;

a transformer including first and second sets of primary windings and a set of secondary windings wherein the second set of primary windings is coupled to an output of the second inverter;

means operable in the generating mode for coupling the rectifier to the generator armature windings and the first set of primary windings to an output of the first inverter and operable in the starting mode for coupling the source of AC power to the set of secondary windings, the first set of primary windings to the rectifier and the output of the first inverter to the generator armature windings; and means for controlling the inverters in the generating mode to convert DC power on the DC link into fixed frequency AC power which is developed in the set of secondary windings and for controlling the first inverter in the starting mode whereby AC power induced in the first set of primary windings due to application of AC power to the set of secondary windings is converted into DC power on the DC link and the DC power is converted into AC power at a controlled frequency by the first inverter and is applied to the generator armature windings.

2. The power conversion system of claim 1, wherein the first set of primary windings are connected in a wye configuration.

3. The power conversion system of claim 1, wherein the second set of primary windings are connected in a delta configuration.

4. The power conversion system of claim 1, wherein the controlling means comprises a control unit which operates the inverters to produce a stepped AC waveform in the set of secondary windings in the generating mode.

5. A power conversion system utilizing a generator having armature windings and coupled to a prime mover wherein the power conversion system is operable in a generating mode to convert motive power developed by the prime mover into electrical power and in a starting mode to convert electrical power developed by a source of AC power into motive power for starting the prime mover, comprising:

a rectifier having an output coupled to a DC link;

first, second, third and fourth inverters each for converting DC power on the DC link into AC power;

a transformer including first, second, third and fourth sets of primary windings and a set of secondary windings wherein the second and fourth sets of primary windings are coupled to outputs of the second and fourth inverters, respectively; and means operable in the generating mode for coupling the rectifier to the generator armature windings and the first and third sets of primary windings to outputs of the first and third inverters, respectively, so that AC power produced by the generator is converted into DC power on the DC link and the DC power is converted into fixed frequency AC power which is developed in the set of secondary windings and operable in the starting mode for coupling the source of AC power to the set of secondary windings, the first and third sets of primary windings to the rectifier and the outputs of the first and third inverters to the generator armature windings so that AC power induced in the first and third sets of primary windings due to application of AC power to the set of secondary windings is converted into DC power on the DC link and the DC power is converted into AC power at a controlled frequency and is applied to the generator armature windings.

6. The power conversion system of claim 5, wherein each of the first and third sets of primary windings includes windings connected in a wye configuration.

7. The power conversion system of claim 5, wherein each of the second and fourth sets of primary windings includes windings connected in a delta configuration.

8. The power conversion system of claim 5, further including means for operating the inverters to produce a 24-step AC waveform in the set of secondary windings in the generating mode.

* * * * *